United States Patent [19]

Tatematsu et al.

[11] Patent Number: 4,993,232

[45] Date of Patent: Feb. 19, 1991

[54] AUGER TYPE ICE MAKING MACHINE

[75] Inventors: Susumu Tatematsu; Junichi Hida; Hideyuki Ikari; Naoya Uchida, all of Toyoake, Japan

[73] Assignee: Hoshizaki Denki Kabushiki Kaisha, Toyoake, Japan

[21] Appl. No.: 520,468

[22] Filed: May 8, 1990

[30] Foreign Application Priority Data

May 12, 1989 [JP] Japan ..... 1-53961[U]
May 12, 1989 [JP] Japan ..... 1-53963[U]

[51] Int. Cl.[5] ..... F25C 5/18

[52] U.S. Cl. ..... 62/137; 340/612; 200/61.2; 222/64

[58] Field of Search ..... 62/137; 200/61.2, 61.21; 340/612, 617; 222/564, 64; 414/299

[56] References Cited

U.S. PATENT DOCUMENTS

| | | | |
|---|---|---|---|
| 3,192,734 | 7/1965 | Swanson | 62/137 |
| 3,274,791 | 9/1966 | Edmisten | 62/137 |
| 3,482,742 | 12/1969 | Baehr | 222/564 |
| 4,662,182 | 5/1987 | Tsukiyama et al. | 62/137 |
| 4,884,722 | 12/1989 | Podd | 222/564 X |

*Primary Examiner*—Tapolcai William E.

*Attorney, Agent, or Firm*—Brooks Haidt Haffner & Delahunty

[57] ABSTRACT

An auger type ice making machine comprises an ice storage level detecting apparatus (5) including an ice storage level sensing plate (5*a*) disposed within an ice guide barrel (3) at a position opposing to an ice discharge port (2). A pair of guide plates (7) for guiding ice discharged from the ice discharged port toward a center portion of the ice storage level sensing plate are mounted on both side walls (3*b*) of the ice guide barrel (3) closely adjacent to the ice storage level sensing plate (5). By mounting the paired guide plates (7), gaps otherwise taking place between the ice storage level sensing plate (5) and the ice guide barrel (3) are closed to thereby prevent the ice from moving to the rear side of the ice storage level sensing plate by circumventing it. The ice storage level sensing plate is thus protected from being blocked. Another guide plate (9) inclined toward a center region of the ice storage level sensing plate (5) is provided on a ceiling plate (3*a*) of the ice guide barrel (3) closely adjacent to a tip end (5*d*) of the ice storage level sensing plate (5*a*) to thereby prevent ice from intruding between the ice storage level sensing plate and the ceiling plate (3*a*).

14 Claims, 3 Drawing Sheets

AUGER TYPE ICE MAKING MACHINE

BACKGROUND OF THE INVENTION

1. Field of the Invention

The present invention relates generally to an auger type ice making machine and more specifically to an auger type ice making machine which comprises an ice guide barrel for interconnecting an ice discharge port of an ice making section to an ice storage section, and an ice storage level detecting apparatus including an ice storage level sensing plate disposed within the ice guide barrel at a position opposite to the ice discharge port.

2. Description of the Prior Art

In an auger type ice making machine known heretofore, an ice storage level detecting apparatus is disposed within the ice guide barrel or a cylinder at the bottom portion thereof with the sensitive surface of an ice storage level sensing plate being so positioned that it can respond to a pile of ice pieces or pellets upon reaching a predetermined level. In another known auger type ice making machine, the ice storage level detecting apparatus is disposed within the ice guide barrel at the top thereof, wherein an ice storage level sensing plate is installed at a position opposite to the ice discharge port through which the ice is pushed out under pressure from the intrinsic ice making section of the machine.

More specifically, referring to FIG. 5 of the accompanying drawings, there is shown one example of a prior art auger type ice making machines, wherein ice pellets manufactured by the ice making section or mechanism 1 are stored into an ice storage box 4 through a discharge port 2 and a guide cylinder or barrel 3. When the amount of ice stored or accumulated within the ice storage box increases to a level beyond an ice storage level sensing plate 5*a*, the latter is caused to swing or rotate under the weight of ice to thereby open a switch for stopping the ice making operation. (reference may be made to Japanese Utility Model Application Laid-Open No. 18474/1985). On the other hand, in the case of the prior art structure shown in FIG. 6 of the accompanying drawings, ice manufactured by the ice making section 1 is stored into the ice storage box through a discharge port 2 and an ice guide cylinder or barrel 3. As the ice storage chamber becomes full of ice, the ice begins to accumulate within the ice guide barrel 3 as well. When the ice thus accumulated has reached the position of an ice storage level sensing plate 5*a*, the ice pushed out from the discharge port causes the ice storage level sensing plate 5*a* to rotate or swing into an inclined position in which the plate is then held stationary, as a result of which the tip end portion 5*d* of the ice storage level sensing plate 5*a* is moved away from a contactless switch 6 to open the switch, thus stopping the ice making operation (reference may be made to FIG. 4 of Japanese Utility Model Application Laid-Open No. 98961/1986).

In the prior art auger type ice making machines and in particular in the case of the machine disclosed in Japanese Utility Model Application Laid-Open No. 18474/1985 above in which a pile of ice pellets come into contact with the sensitive surface of the ice storage level sensing plate 5*a* of the ice storage detecting apparatus, there is the problem that the ice pellets which trigger actuation of the ice storage detecting apparatus 5 tend to be melted by heat conduction taking place on the contacting surface, as a result of which the ice storage level sensing plate 5*a* may repeatedly be actuated and restored, leading ultimately to the hollowing-out of the stored ice mass in the region susceptible to the operation of the ice storage level sensing plate 5*a*, which in turn renders the ice storage detection impossible.

On the other hand, in the case of the ice storage level detecting apparatus for the auger type ice making machine disclosed in Japanese Utility Model Application Laid-Open No. 98961/1986 above, the ice mass hollowing phenomenon mentioned does not occur because of the significant magnitude of ice push-out force. However, this auger type ice making machine suffers from many problems in that ice pellets are likely to move to the rear of the ice storage level sensing plate through gaps formed between sides of the ice storage sensing plate and both side walls of the ice guide barrel to thereby block the rotation of the ice storage level sensing plate and in that when the tip end of the ice storage level sensing plate is moved away from the contactless switch, some of the pushed-out ice may intrude between the tip end and the horizontal portion of the ice storage level sensing plate and the cover or ceiling plate of the ice guide barrel thereby obstructing the restoration of the ice storage level sensing plate to the starting state. These problems become more serious particularly in the winter season because the intervening ice pellets do not readily melt due to low ambient temperatures, in which case, it is not rare that the ice making operation can no longer be performed.

SUMMARY OF THE INVENTION

Accordingly, a principal object of the present invention is to provide an auger type ice making machine including an ice storage level detecting apparatus having an ice storage level sensing plate disposed in opposition to an ice discharge port, in which ice pushed out from the discharge port can be positively prevented from moving to the rear side of the ice storage level sensing plate by circumventing it.

It is another object of the present invention to provide an auger type ice making machine equipped with an ice storage level detecting apparatus, which can prevent not only the move of ice pellets to the rear side of an ice storage level sensing plate, but also intrusion of ice pellets between the ice storage level sensing plate and a ceiling plate of the ice guide barrel.

In view of the above and of other objects which will be apparent as the description proceeds, the invention provides an auger type ice making machine, which comprises an ice guide barrel for interconnecting an ice discharge port with an ice storage section, and an ice storage level detecting apparatus including an ice storage level sensing plate disposed swingably within the ice guide barrel at a position opposite the ice discharge port, wherein first guide means for guiding the ice discharged from the ice discharge port toward a center region of the ice storage level sensing plate is mounted on both side walls of the ice guide barrel at a position closely adjacent to the ice storage level sensing plate.

With the arrangement where the first guide means for guiding ice discharged from the discharge port of the intrinsic ice making section toward a center region of the ice accumulation or storage level sensing plate is mounted on both side walls of the ice guide barrel closely adjacent to the ice storage level sensing plate, gaps which would otherwise take place between both sides of the ice storage level sensing plate and both side walls of the ice guide barrel, respectively, are closed or blocked by the first guide means, whereby the pressure under which the ice is discharged from the discharge port can be directly concentrated towards the center region of the ice storage level sensing plate, whereby circumvention or movement of ice to the rear side of the ice storage level sensing plate is positively prevented to thereby ensure the rotation of the ice storage level sensing plate and hence the ice storage detection.

In a preferred embodiment of the invention, a second guide member which is inclined toward a center portion of the ice guide barrel is disposed on a ceiling plate thereof closely adjacent to the tip end of the ice storage level sensing plate, thereby preventing the ice from intruding between the ice storage level sensing plate and the ceiling plate. By providing the second guide member in this manner, the gap between it and the tip end of the ice storage level sensing plate is decreased upon swinging of the ice storage level sensing plate, leaving no room for the ice to intrude through the gap.

Other objects, advantages and novel features in accordance with the present invention will become more apparent from the following detailed description of preferred or exemplary embodiments thereof, when considered in conjunction with the accompanying drawings.

DETAILED DESCRIPTION OF THE INVENTION

In the following, the auger type ice making machine according to the present invention will be described in detail in conjunction with preferred or exemplary embodiments thereof by reference to the accompanying drawings, in which like reference symbols denote same or equivalent parts throughout the several figures.

Figure 1:
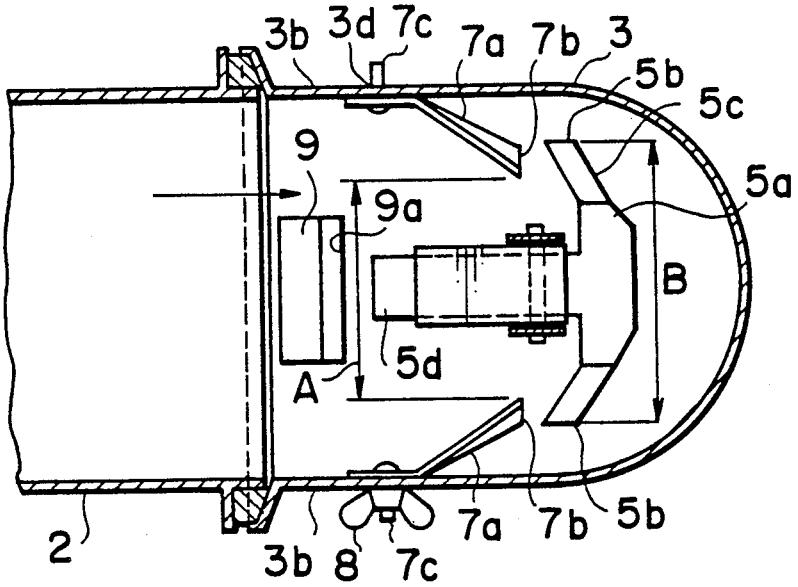
FIG. 1 is a plan view showing, partially in section, a major portion of an auger type ice making machine according to an embodiment of the present invention.
Figure 2:
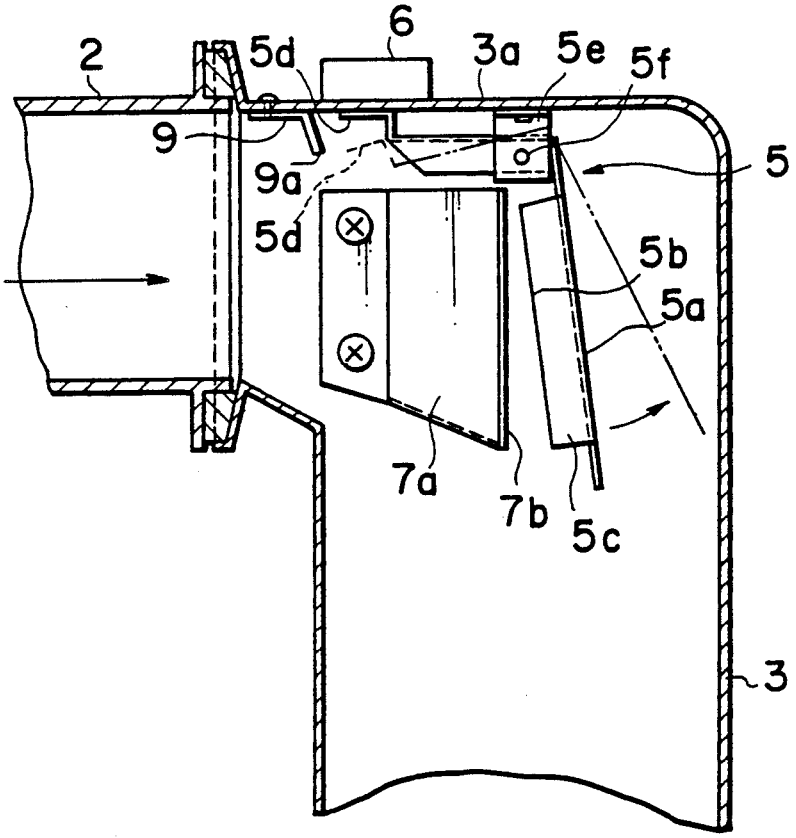
FIG. 2 is an elevational view showing, partially in section, the major portion of the auger type ice making machine shown in FIG. 1.

Now referring to FIGS. 1 and 2, an ice discharge port 2 disposed substantially horizontally for receiving ice pellets manufactured by and fed out under pressure from an auger type ice making unit (not shown) of an ice making machine is communicated to an ice storage chamber constituted by an ice storage box (also not shown) by way of a barrel-shaped or cylindrical ice guide member 3 standing substantially vertically. The ice guide barrel 3 has a top portion constituted by a ceiling plate member 3*a* and a pair of opposite side walls 3*b*, 3*b*, while a lower portion of the ice guide barrel 3 is realized substantially in the form of hollow cylindrical and connected to the ice storage box (not shown). Installed within the ice guide barrel 3 is an ice storage level detecting apparatus denoted generally by a numeral 5 which is composed of a stationary supporting structure 5*e* secured fixedly to the ceiling plate member 3*a* and including a pin 5*f* and an ice storage level sensing plate 5*a* mounted pivotally or rotatably on the pin 5*f*. The ice storage level sensing plate 5*a* is configured as a whole substantially in an L-like form and includes a vertical leg portion and a horizontal leg portion, each having substantially a channel-like section. The vertical leg portion of the ice storage level sensing plate 5*a* has a pair of opposite side members 5*c*, 5*c* which extend divergently from the center or main body of the vertical leg portion and terminate in side edges 5*b*, 5*b*, respectively. On the other hand, the horizontal leg portion of the ice storage level sensing plate 5*a* is formed with a tip end portion 5*d* of an L-like configuration which extends to a position corresponding to that of a contactless switch 6 mounted externally on the ceiling plate member 3*a*. The pin 5*f* extends through the channel-like horizontal leg portion at an end thereof located in the vicinity of the upper end of the vertical leg portion of the L-like ice storage level sensing plate 5*a* and supports rotatably the latter in such a manner that the vertical leg portion thereof is ordinarily held in the state slightly inclined counterclockwise relative to the vertical as viewed in the direction in which the ice is discharged.

Disposed upstream of the ice storage level sensing plate 5*a* with respect to the ice discharge direction indicated by an arrow in FIGs. 1 and 2 are a pair of first guide members 7*a*, 7*a* extending from the opposite side walls 3*b*, 3*b* of the ice guide barrel 3, respectively, wherein each of the guide members 7*a*, 7*a* made of a plate bent substantially in a chevron-like shape as viewed in section (FIG. 1). The guide members or plates 7*a* are removably clamped to the respective side walls 3*b* of the ice guide barrel 3 by means of clamping screws 7*c* extending through a screw hole 3*d* and a wing nut 8 in such disposition that free vertical edges 7*b*, 7*b* of the guide plates 7*a*, 7*a* are positioned as closely as possible to the side edges 5*b*, 5*b* of the vertical leg portion of the ice storage level sensing plate 5, respectively, as best shown in FIG. 1. The distance A between the free edges 7*b*, 7*b* of the guide plates 7*a*, 7*a* is selected to be smaller than the distance B between the side edges 5*b*, 5*b* of the vertical leg portion of the ice storage level sensing plate 5*a* so that the ice can be discharged toward a center region of the vertical leg portion of the ice storage level sensing plate 5*a*. The bottom ends of the guide plates 7*a*, 7*a* should preferably be positioned at a level equal to or slightly higher than that of the bottom ends of the vertical leg portions of the ice storage level sensing plate 5*a*. Also, the free edges 7*b*, 7*b* of the guide plate 7*a*, 7*a* should preferably be so designed that the distance therebetween is progressively increased in the direction from the top toward the bottom in order to prevent the ice from forming a bridge between the exit of the ice discharge port 2 and the guide plates 7*a*, 7*a*.

For controlling the ice discharge direction, there is further provided a second guide member 9 which is disposed upstream of the guide plates 7*a*, 7*a* as viewed in the ice discharge direction and mounted fixedly to the ceiling plate 3*a* of the ice guide barrel 3 (see FIG. 2). The second guide member 9 is formed of a plate having a chevron-like section and secured screwwise to the ceiling plate or wall 3*a* at a position closely adjacent to the tip end 5*d* of the horizontal leg portion of the ice storage level sensing plate 5a in such disposition that a trailing end portion 9a of the second guide member 9 as viewed in the ice discharge direction is inclined toward the center axis of the ice guide barrel 3.

As shown in FIG. 1, the second guide member 9 has a width greater than that of the tip end portion 5d of the horizontal leg portion of the ice storage level sensing plate 5a, while the length of the second guide member 9 is so selected that the trailing end 9a thereof is positioned at substantially the same location as the tip end 5d of the horizontal leg portion of the ice storage level sensing plate 5a when the latter is rotated or swung to a position indicated by a phantom line in FIG. 2. Alternatively, the trailing end portion 9a of the guide member 9 may extend toward the center of the ice guide barrel 3 beyond the tip end 5d of the horizontal leg portion of the ice storage level sensing plate 5a.

It should further be mentioned that the second guide member 9 is not limited to the plate-like configuration but may be implemented in the form of a block having a triangular section, a protrusion of a triangular section formed integrally with the ceiling wall 3a of the ice guide barrel or in other appropriate form.

In operation, the ice pellets manufactured by the auger type ice making section (not shown) are discharged through the ice discharge port 2 to be stored in the ice storage box (not shown) by way of the ice guide barrel 3. Assuming that the ice storage chamber is filled with ice, as the result of which the ice pellets are accumulated within the ice guide barrel 3 up to a level reaching the position of the ice storage level sensing plate 5a, the pressure or force under which the ice is pushed out through the ice discharged port 2 acts on the vertical leg portion of the ice storage level plate 5a, whereby the latter is forced to rotate or swing about the pin 5f of the stationary support 5e, resulting in that the tip end 5d of the horizontal leg portion of the ice storage level sensing plate 5a is moved away from the contactless switch 6. In this manner, the ice making operation of the auger type ice making machine is stopped by the ice storage level detecting apparatus 5.

Since the guide plates 7a, 7a are mounted on the side walls 3b, 3b of the ice guide barrel 3, respectively, in such disposition that the free edges 7b, 7b of the gird plate 7a, 7a are positioned as closely as possible to the vertical leg portion of the ice storage level sensing plate 5a and with such inclination that the ice as discharged is directed toward the center region of the vertical leg portion of the ice storage level sensing plate 5a, as described above, there are substantially no gaps between the side walls 3b, 3b of the ice guide barrel 3 and the side edges 5b, 5b of the vertical leg portion of the ice storage level sensing plate 5a. Also, the ice pellets are positively prevented from moving to the rear side of the vertical leg portion through the gaps between the free edges 7b, 7b of the guide plate 7a, 7a and the side edges 5a, 5a of the ice storage level sensing plate 5a. Further, even when the ice making operation is performed in the state in which the vertical leg portion of the ice storage level sensing plate 5a has been swung, with the ice being discharged through the port 2, the second guide member 9 serves to fully prevent the ice from intruding through the gaps between the horizontal leg portion of the ice storage level sensing plate 5a (particularly the tip end 5d of the horizontal leg portion thereof) and the ceiling plate 3a. Thus, the ice storage level sensing plate 5a can be actuated without fail in response to the force under which the ice is pushed outwardly, to thereby prevent the occurrence of such unwanted situations where the storage level of ice can not be detected.

It should be added that the guide plates 7a constituting the first guide means can be easily removed according to need, since they are clamped by means of the combination of screws 7c extending through the holes 3d and the wing nuts 8 threadedly fitted onto the screws 7c. Thus, the guide plates 7a provide no obstacle to sterilization, cleaning and other maintenance as required.

Figure 3:
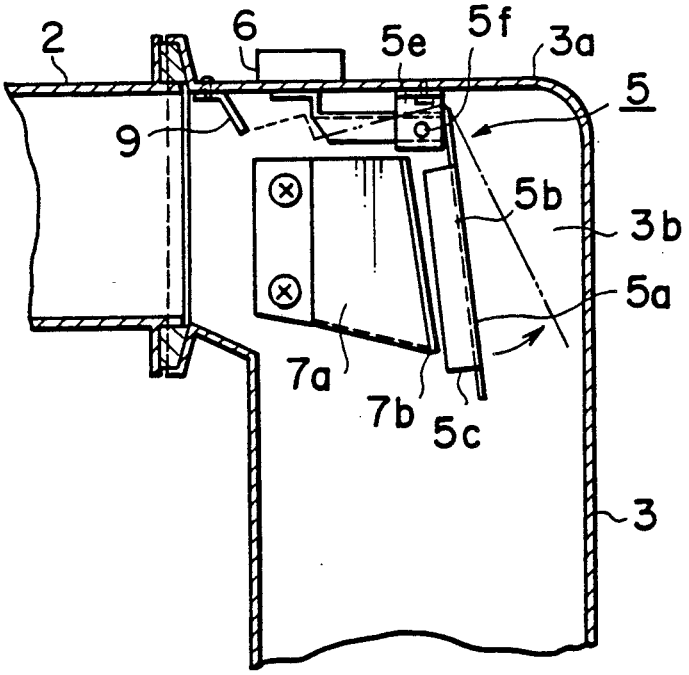
FIG. 3 is an elevational view showing, partially in section, a major portion of an auger type ice making machine according to another embodiment of the invention.

FIG. 3 shows a modified embodiment of the invention according to which the guide plates 7a, 7a each have a width increasing linearly toward the bottom edge thereof so that the respective free edges 7b of the guide plates 7a extend substantially in parallel with the side edges 5b of the vertical leg portion of the ice storage level sensing plate 5a so that the gap between them remains substantially constant relative to the ice storage level sensing plate 5a mounted with a small inclination in the counterclockwise direction as viewed in FIG. 3.

Figure 4A:
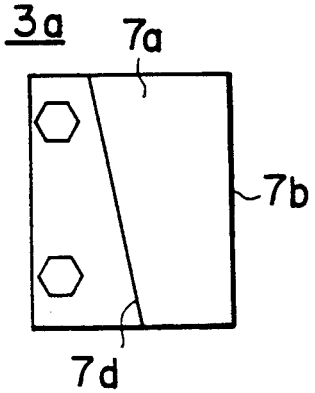
FIGS. 4A and 4B are side and front elevational views showing schematically a major portion of an auger type ice making machine according to still another embodiment of the invention.
Figure 4B:
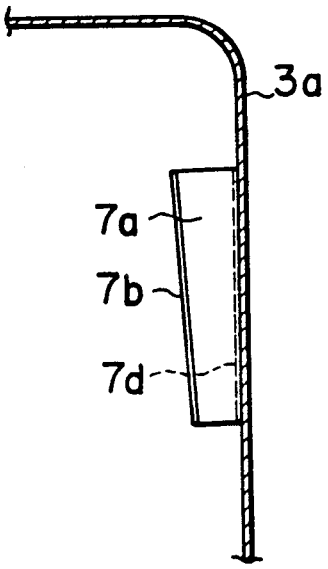
Figure 5:
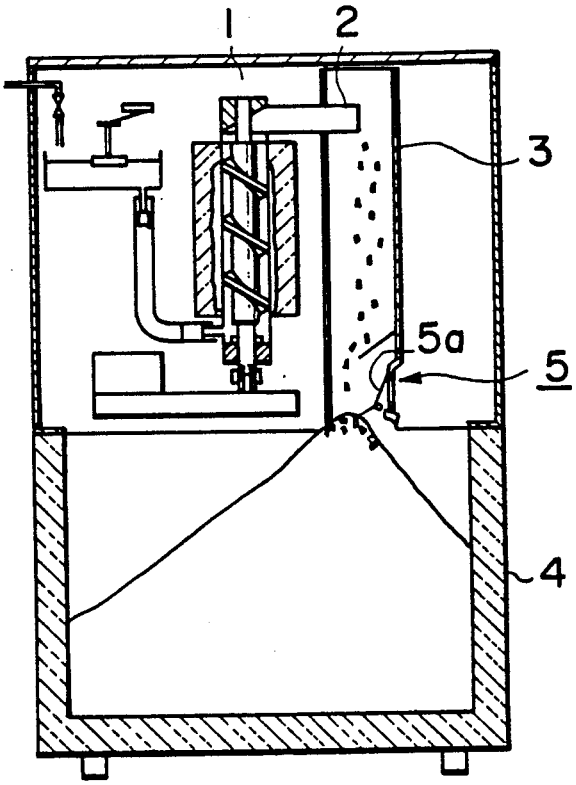
FIG. 5 PRIOR ART
FIG. 5 is a sectional view showing the general structure of an auger type ice making machine known heretofore.
Figure 6:
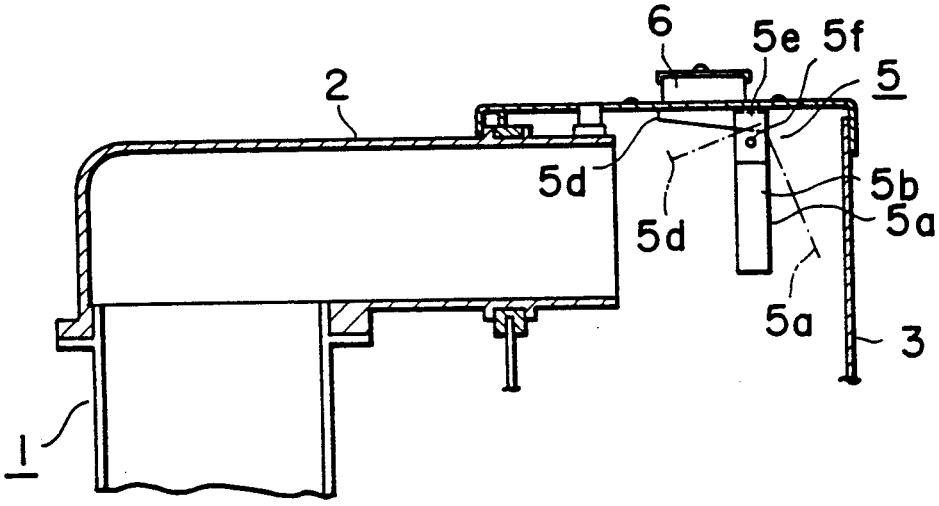
FIG. 6 PRIOR ART
FIG. 6 is a schematic sectional view showing a major portion of another type ice making machine known heretofore.

FIGS. 4A and 4B show another modified embodiment of the present invention according to which both the guide plates 7a, 7a are so implemented that the distance between the free edges 7b, 7b as well as the effective surfaces thereof are progressively increased towards the top with the ridge of the chevron-like section extending obliquely counterclockwise respective to the vertical, as can clearly be seen in FIG. 4.

As will now be appreciated from the foregoing description, the present invention teaches an improved structure of the ice storage level detecting apparatus in which the guide plates for guiding the ice pellets discharged from the outlet port toward the center region of the ice storage level sensing plate are mounted on both side walls of the ice guide barrel at positions closely adjacent to the ice storage level sensing plate. By virtue of this structure, such situations in which the ice pellets might be undesirably caused to move to the rear side of the ice storage level sensing plate to thereby block the rotation thereof and hence render inoperative the ice storage level detection can be positively avoided. Further, by mounting the second ice guide so as to be inclined toward the center of the ice guide barrel on the ceiling plate thereof at a position closely adjacent to the tip end of the ice storage level sensing plate, ice can be positively prevented from intruding between the ice storage level sensing plate and the ceiling wall, whereby restoring operation of the ice storage level sensing plate can be protected against blockage. In this way, it is possible according to the invention to reduce problems otherwise taking place in the ice storage level detecting apparatus.

It is through that the present invention will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

We claim:

1. An auger type ice making machine, comprising an ice making section, an ice discharge port (2) connected to said ice making section for receiving manufactured ice, an ice storage section for storing said ice, an ice guide barrel (3) for interconnecting said ice discharge port (2) and said ice storage section, and an ice storage level detecting apparatus (5) including an ice storage level sensing plate (5*a*) disposed swingably within said ice guide barrel (3) at a position opposite to said ice discharge port (2), characterized in that first guide means (7*a*) for guiding the ice discharged from said ice discharge port (2) toward a center portion of said ice storage level sensing plate (5*a*) is mounted on both side walls of the said ice guide barrel (3) at a position closely adjacent to said ice storage level sensing plate (5*a*).

2. An auger type ice making machine according to claim 1, wherein said ice guide barrel (3) having an upper portion including a ceiling plate (3*a*) and a pair of side walls (3*b*) connected to said ceiling plate (3*a*), said ice guide barrel being coupled to said ice discharging port (2) at said upper portion, and which further comprises a contactless switch (6) mounted on said ceiling plate (3*a*), said contactless switch (6) being adapted to be actuated when said ice storage level sensing plate (5*a*) is swung upon detecting an ice filled state, to thereby stop operation of said auger type ice making machine.

3. An auger type ice making machine according to claim 2, wherein said ice storage level sensing plate (5*a*) is constituted by a vertical portion and a horizontal portion substantially in an L-like configuration, and said vertical portion is provided with side edges (5*b*) extending from both sides of a main body of said vertical portion divergently from each other toward said ice discharge port (2), while said horizontal portion has a tip end portion (5*d*) extending to a position corresponding to that of said contactless switch (6).

4. An auger type ice making machine according to claim 3, wherein said first guide means includes a pair of guide plates (7*a*) mounted on both of said side walls (3*b*), respectively, of said ice guide barrel (3), said pair of guide plates (7*a*) extending convergently to each other toward both sides of the vertical portion of said ice storage level sensing plate (5*a*).

5. An auger type ice making machine according to claim 4, wherein a distance between free edges (7*b*) of said pair of mutually converging guide plates (7*a*) is smaller than a distance between the side edges (5*b*) of said vertical portion of said ice storage level sensing plate (5*a*).

6. An auger type ice making machine according to claim 4, wherein bottom ends of the free edges (7*b*) of said paried guide plates (7*a*) extend closely adjacent to the positions of bottom ends of said side edges (5*b*) of said vertical portion of said ice storage level sensing plate (5*a*), respectively.

7. An auger type ice making machine according to claim 5, wherein the distance between the free edges (7*b*) of said paired guide plates (7*a*) is increased progressively from the top toward the bottom.

8. An auger type ice making machine according to claim 3, further comprising second guide means (9) disposed upstream of said tip end (5*d*) of said horizontal portion of said ice storage level sensing plate (5*a*) with respect to a direction in which ice is discharged from said ice discharge port (2), wherein said second guide means (7*a*) extends toward a position occupied by said tip end (5*d*) of said horizontal portion upon swinging of said ice storage level sensing plate (5*a*).

9. An auger type ice making machine according to claim 8, wherein said second guide means is composed of a chevron plate (9) having a chevron-like section and mounted on said ceiling plate (3*a*), said chevron plate having a tip end (9*a*) inclined toward an upper center region of said ice guide barrel (3).

10. An auger type ice making machine according to claim 9, wherein said second guide means (9) has a width greater than that of the tip end (5*d*) of the horizontal portion of said ice storage level sensing plate (5*a*), while said tip end (9*a*) of said second guide means (9) extends to a position substantially coinciding with that of the tip end (5*d*) of the horizontal portion of said ice storage level sensing plate (5*a*) upon swinging thereof.

11. An auger type ice making machine according to claim 8, wherein said second guide means (9) is constituted by a block of a substantially triangular shape.

12. An auger type ice making machine according to claim 8, wherein said second guide means (9) is constituted by a protrusion of a substantially triangular shape formed integrally with said ceiling plate (3*a*).

13. An auger type ice making machine according to claim 4, wherein gaps defined between said side edges (5*b*) of the vertical portion of said ice storage level sensing plate (5*a*) and said free edges (7*b*) of said paired guide plates (7*a*), respectively, are each of a substantially constant width from the bottom of either said side edge (5*b*) or said free edge (7*b*) to the top thereof, so long as said ice storage level sensing plate (5*a*) remains stationary.

14. An auger type ice making machine according to claim 4, wherein distance between the free edges (7*b*) of said paired guide plates (7*a*) is decreased toward the top, while said paired guide plates (7*a*) spaced from the side walls (3*b*) of said ice guide barrel (3) are formed such that the guide surface areas thereof are increased toward the top.

* * * * *